US009887028B2

(12) United States Patent
Inoue et al.

(10) Patent No.: US 9,887,028 B2
(45) Date of Patent: Feb. 6, 2018

(54) SUPERCONDUCTING MAGNET

(71) Applicant: MITSUBISHI ELECTRIC CORPORATION, Chiyoda-ku, Tokyo (JP)

(72) Inventors: Tatsuya Inoue, Tokyo (JP); Hajime Tanabe, Tokyo (JP)

(73) Assignee: MITSUBISHI ELECTRIC CORPORATION, Chiyoda-ku, Tokyo (JP)

( * ) Notice: Subject to any disclaimer, the term of this patent is extended or adjusted under 35 U.S.C. 154(b) by 0 days.

(21) Appl. No.: 15/320,967

(22) PCT Filed: Sep. 3, 2014

(86) PCT No.: PCT/JP2014/073129
§ 371 (c)(1),
(2) Date: Dec. 21, 2016

(87) PCT Pub. No.: WO2016/035153
PCT Pub. Date: Mar. 10, 2016

(65) Prior Publication Data

US 2017/0200541 A1 Jul. 13, 2017

(51) Int. Cl.
*H01F 1/00* (2006.01)
*H01F 6/04* (2006.01)
*H01F 6/06* (2006.01)

(52) U.S. Cl.
CPC *H01F 6/04* (2013.01); *H01F 6/06* (2013.01)

(58) Field of Classification Search
CPC ..... H01F 6/04
(Continued)

(56) References Cited

U.S. PATENT DOCUMENTS 5,220,800 A * 6/1993 Muller ..... G01R 33/3815 335/216
5,347,251 A * 9/1994 Arrendale ..... H01F 6/065 174/15.5
(Continued)

FOREIGN PATENT DOCUMENTS

JP S55-22846 A 2/1980
JP H03-88366 U 9/1991
(Continued)

OTHER PUBLICATIONS

Decision to Grant Patent dated May 26, 2015 in corresponding Japanese Patent Appln. No. 2015-510224 (3 pages).
(Continued)

*Primary Examiner* — Alexander Talpalatski
(74) *Attorney, Agent, or Firm* — Buchanan Ingersoll & Rooney PC

(57) ABSTRACT

A superconducting magnet includes: a superconducting coil; a coolant container; a radiation shield; a vacuum container; a refrigerator; a current lead; a first pipe including a mounting opening in which the refrigerator is inserted and fixed; a second pipe including a lead-out opening through which the current lead passes to be led out; and a flow rate ratio maintaining mechanism connected to at least one of the downstream side of the mounting opening of the first pipe and the downstream side of the lead-out opening of the second pipe, the flow rate ratio maintaining mechanism allowing the vaporized coolant to flow through the first pipe and the second pipe at a constant flow rate ratio.

4 Claims, 2 Drawing Sheets

(58) Field of Classification Search
USPC ..... 335/216
See application file for complete search history.

(56) References Cited

U.S. PATENT DOCUMENTS

| | | | | |
|---|---|---|---|---|
| 5,396,206 | A * | 3/1995 | Herd | H01F 6/065 174/125.1 |
| 5,410,286 | A * | 4/1995 | Herd | F25D 29/001 335/216 |
| 8,797,131 | B2 * | 8/2014 | Jiang | G01R 33/3804 335/216 |
| 2016/0233011 | A1 * | 8/2016 | Eguchi | G01R 33/3804 |

FOREIGN PATENT DOCUMENTS

| | | | |
|---|---|---|---|
| JP | H05-182829 | A | 7/1993 |
| JP | H06-29109 | U | 4/1994 |
| JP | H08-159633 | A | 6/1996 |
| JP | H08-316021 | A | 11/1996 |
| JP | 2000-105072 | A | 4/2000 |
| JP | 2002-270913 | A | 9/2002 |
| JP | 2005-111058 | A | 4/2005 |
| JP | 2007-167517 | A | 7/2007 |
| JP | 2007-329320 | | 12/2007 |
| JP | 2011-253873 | | 12/2011 |

OTHER PUBLICATIONS

International Search Report (Form PCT/ISA/210) dated Nov. 25, 2014 by the Japanese Patent Office in corresponding International Application No. PCT/JP2014/073129, with English translation (5 pages).

Written Opinion of the International Search Authority dated Nov. 25, 2014 by the Japanese Patent Office in corresponding International Application No. PCT/JP2014/073129 (4 pages).

First Office Action dated Oct. 16, 2017 issued by The State Intellectual Property Office of People's Republic of China in the corresponding Chinese Patent Application No. 201480081731.1 and English translation (9 pages).

* cited by examiner

SUPERCONDUCTING MAGNET

TECHNICAL FIELD

The present invention relates to a superconducting magnet and more particularly to a superconducting magnet with a fixed-type refrigerator and a fixed-type current lead which are non-removable.

BACKGROUND ART

A prior art document, Japanese Patent Laying-Open No. 8-159633 (PTD 1), discloses a cryogenic apparatus for a superconducting magnet where liquid helium is used as cryogenic coolant, the cryogenic apparatus uniformly cooling radiation shields so as to suppress an increase in amount of heat intrusion into a cryogenic coolant tank. In the cryogenic apparatus disclosed in PTD 1, a radiation-shield cooling pipe is composed of a plurality of radiation-shield cooling pipes constituted of parallel flow paths. Each of the radiation-shield cooling pipes constituted of parallel flow paths is provided with a flow rate control valve around its exit which is varied in position with a change in temperature of the coolant flowing in the flow path.

A prior art document, Japanese Patent Laying-Open No. 2000-105072 (PTD) 2), discloses a multi-circulation type liquid helium recondensation apparatus that cools a helium storage tank with sensible heat of helium gas. A prior art document, Japanese Utility Model Laying-Open No. 3-88366 (PTD 3), discloses a superconducting magnetic shield that cools a radiation shield with sensible heat of helium gas.

In the multi-circulation type liquid helium recondensation apparatus disclosed in PTD 2, a major part of the helium gas is cooled to about 40 K by a first heat exchanger of a small-sized refrigerator while positions of flow rate regulating valves are being adjusted, and the cooled helium gas is supplied into the liquid helium storage tank through a flow path. The rest of the helium gas is liquefied through the first heat exchanger and a second heat exchanger of the small-sized refrigerator, and the liquid helium is supplied into the liquid helium storage tank through a flow path.

In the superconducting magnetic shield disclosed in PTD 3, a heat transfer plate is disposed on the outer side of a liquid helium container in such a way as to surround the liquid helium container, and pipes for the passage of helium gas are provided in contact with the outer peripheral surface of the heat transfer plate.

CITATION LIST

Patent Document

PTD 1: Japanese Patent Laying-Open No. 8-159633
PTD 2: Japanese Patent Laying-Open No. 2000-105072
PTD 3: Japanese Utility Model Laying-Open No. 3-88366

SUMMARY OF INVENTION

Technical Problem

With regard to the superconducting magnet disclosed in PTD 1, when there is no electric power supply, e.g., during a power breakdown or transportation, the flow rate control valves do not work and it is difficult to suppress heat intrusion into the coolant container. With regard to the multi-circulation type liquid helium recondensation apparatus disclosed in PTD 2, when there is no electric power supply, e.g., during a power breakdown or transportation, the flow rate regulating valves do not work and it is difficult to suppress heat intrusion into the coolant container. With regard to the superconducting magnetic shield disclosed in PTD 3, no consideration is given to the adjustment of a flow rate of helium gas.

The present invention has been made in view of the above problems. An object of the present invention is to provide a superconducting magnet that can suppress heat intrusion into a coolant container with ability to maintain a flow rate ratio of helium gas between a plurality of flow paths while electric power supply is stopped.

Solution to Problem

A superconducting magnet according to the present invention includes: a superconducting coil; a coolant container containing the superconducting coil in a state where the superconducting coil is immersed in liquid coolant; a radiation shield surrounding the coolant container; a vacuum container containing the superconducting coil, the coolant container, and the radiation shield; a refrigerator for cooling the radiation shield and the inside of the coolant container; a current lead electrically connected to the superconducting coil; a first pipe passing through the vacuum container and the radiation shield and leading to the inside of the coolant container to form a flow path of vaporized coolant, the first pipe including a mounting opening in which the refrigerator is inserted and fixed; a second pipe passing through the vacuum container and the radiation shield and leading to the inside of the coolant container to form another flow path of vaporized coolant, the second pipe including a lead-out opening through which the current lead passes to be led out; and a flow rate ratio maintaining mechanism connected to at least one of a downstream side of the mounting opening of the first pipe and a downstream side of the lead-out opening of the second pipe, the flow rate ratio maintaining mechanism allowing the vaporized coolant to flow through the first pipe and the second pipe at a constant flow rate ratio.

Advantageous Effects of Invention

According to the present invention, a flow rate ratio of helium gas between a plurality of flow paths is maintainable while electric power supply is stopped and thus heat intrusion into a coolant container can be suppressed.

DESCRIPTION OF EMBODIMENTS

Hereinafter superconducting magnets according to embodiments of the present invention are described with reference to the figures. In the description of the embodiments below, identical or equivalent parts are identically denoted in the figures and redundant explanations are not repeated.

Note that although a description of a hollow cylindrical superconducting magnet is given in the following embodiments, the present invention is not necessarily limited to a hollow cylindrical superconducting magnet but may also be applied to an open superconducting magnet.

Embodiment 1

Figure 1:
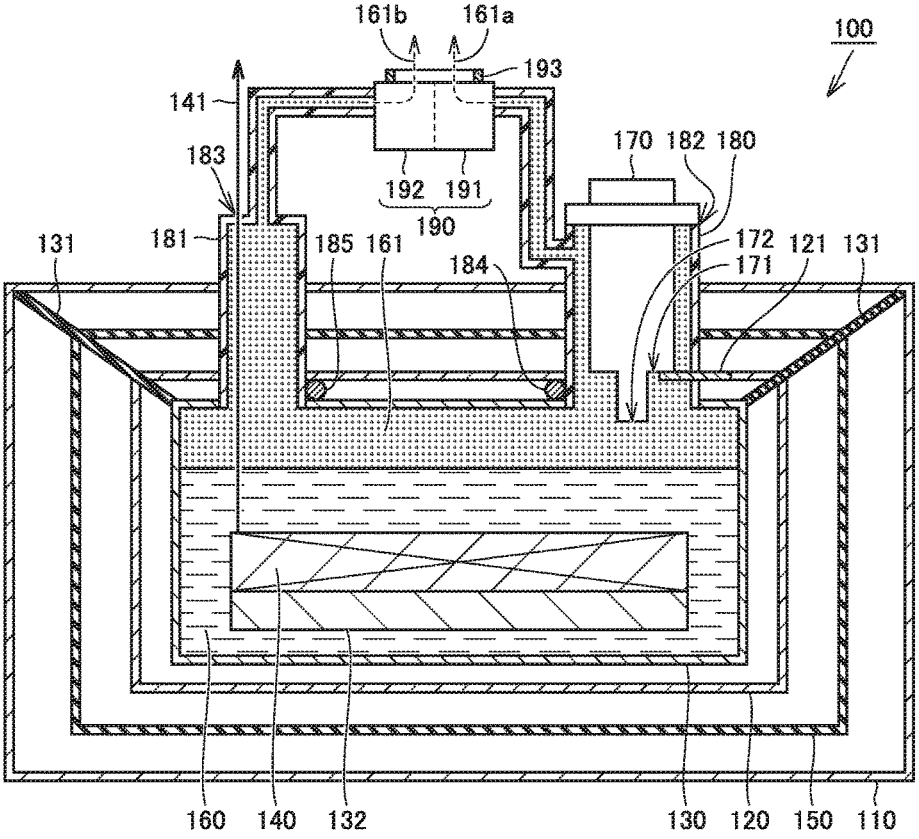
FIG. 1 is a cross-sectional view showing a structure of a superconducting magnet according to Embodiment 1 of the present invention.

FIG. 1 is a cross-sectional view showing a structure of a superconducting magnet according to Embodiment 1 of the present invention. FIG. 1 shows a cross section of only the upper part of the superconducting magnet. As shown in FIG. 1, in a superconducting magnet 100 according to Embodiment 1 of the present invention, a hollow cylindrical vacuum container 110 is disposed on the outermost side. Vacuum container 110 is formed of, for example, a non-magnetic material such as stainless-steel or aluminum for vacuum insulation between the inner and outer sides of vacuum container 110.

The inside of vacuum container 110 is reduced in pressure by a pressure reducing device (not shown) to form a vacuum. In vacuum container 110, a hollow cylindrical radiation shield 120 is disposed that is substantially similar to vacuum container 110 in shape.

Radiation shield 120 is formed of, for example, a non-magnetic material having a high light reflectance, such as aluminum. A multi-layer heat insulating material 150 (super-insulation) is disposed so as to cover the outer side of radiation shield 120. Multi-layer heat insulating material 150 may be attached to the surface of radiation shield 120.

In radiation shield. 120, a hollow cylindrical coolant container 130 is disposed that is substantially similar to radiation shield 120 in shape. Radiation shield 120 serves as a heat insulator between coolant container 130 and vacuum container 110 as surrounding coolant container 130. Coolant container 130 is formed of a non-magnetic material such as stainless-steel or aluminum.

In coolant container 130, a superconducting coil 140 is contained. Superconducting coil 140 is wound around a reel 132 formed of a non-magnetic material such as stainless-steel or aluminum. Reel 132 is supported on a support (not shown) and fixed in coolant container 130 with a gap lying between reel 132 and coolant container 130. Note that superconducting coil 140 may be wound around the bottom of coolant container 130, in which case no reel 132 is provided.

The inside of coolant container 130 is filled with liquid helium 160 which is liquid coolant. Superconducting coil 140 is cooled as being immersed in liquid helium 160. Superconducting coil 140 is made up, for example, by winding a superconducting wire formed of a copper matrix with a niobium-titanium alloy embedded in its center part.

Vacuum container 110 thus contains superconducting coil 140, coolant container 130, and radiation shield 120. Vacuum container 110 is connected to one end of each of support rods 131 made of, for example, glass epoxy. Each support rod 131 is connected to radiation shield 120 and coolant container 130. That is, each of radiation shield 120 and coolant container 130 is fixed to vacuum container 110 with support rods 131.

Although liquid helium 160 is used as coolant in the present embodiment, the type of coolant is not limited to liquid helium but may be any other coolant that can bring superconducting coil 140 into a superconducting state, e.g., liquid nitrogen.

Superconducting magnet 100 includes a refrigerator 170 for cooling radiation shield 120 and the inside of coolant container 130. A Gifford-McMahon refrigerator or a pulse tube refrigerator each having two refrigeration stages may be used as refrigerator 170.

A first refrigeration stage 171 of refrigerator 170 is indirectly connected to radiation shield 120 with a heat transfer plate 121 interposed therebetween. Heat transfer plate 121 is made of, for example, copper and passes through a part of the peripheral wall of a first pipe 180 which is described later. A second refrigeration stage 172 of refrigerator 170 is located in the upper part in coolant container 130 and re-liquefies vaporized helium gas 161.

Refrigerator 170 is inserted through a mounting opening 182 of first pipe 180 which is described later, and is fixed thereto. Refrigerator 170 is sealed with, for example, an O-ring (not shown) so that a gap may not be created between the upper surface of mounting opening 182 of first pipe 180 and the lower surface of a flange of refrigerator 170 while refrigerator 170 is disposed through mounting opening 182. Refrigerator 170 according to the present embodiment is a non-removable fixed-type refrigerator.

Superconducting magnet 100 includes a current lead 141 electrically connected to superconducting coil 140. Current lead 141 is led out from a lead-out opening 183 through the inside of a second pipe 181 which is described later. Current lead 141 is led out from lead-out opening 183 in an airtight fashion. The tip of led-out current lead 141 is connected to a power source (not shown) that supplies electric power. Current lead 141 according to the present embodiment is a non-removable fixed-type current lead. A material for current lead 141 contains phosphorous-deoxidized copper as a major component. The major component of the material for current lead 141, however, is not limited to phosphorous-deoxidized copper but may also be, for example, brass or electrolytic copper.

Superconducting magnet 100 includes first pipe 180 passing through vacuum container 110 and radiation shield 120 and leading to the inside of coolant container 130 to form a flow path of vaporized helium gas 161, first pipe 180 including mounting opening 182 for refrigerator 170 to be inserted therethrough and to be fixed thereto. First pipe 180 is formed of carbon fiber reinforced plastic (CFRP). The material for first pipe 180 is, however, not limited to CFRP but may be any other material that has a low heat conductivity.

At a part where refrigerator 170 is inserted, a continuous gap serving as a flow path of helium gas 161 is provided between the inner peripheral surface of first pipe 180 and the outer peripheral surface of refrigerator 170.

Superconducting magnet 100 includes second pipe 181 passing through vacuum container 110 and radiation shield 120 and leading to the inside of coolant container 130 to form another flow path of vaporized helium gas 161, second pipe 181 including lead-out opening 183 through which current lead 141 passes to be led out. Second pipe 181 is formed of CFRP. The material for second pipe 181 is, however, not limited to CFRP but may be any other material that has a low heat conductivity.

Superconducting magnet 100 includes a flow rate ratio maintaining mechanism 190 that is connected to the downstream side of mounting opening 182 of first pipe 180 and to the downstream side of lead-out opening 183 of second pipe 181, flow rate ratio maintaining mechanism 190 allowing helium gas 161 to flow through first pipe 180 and second pipe 181 at a constant flow rate ratio.

Figure 2:
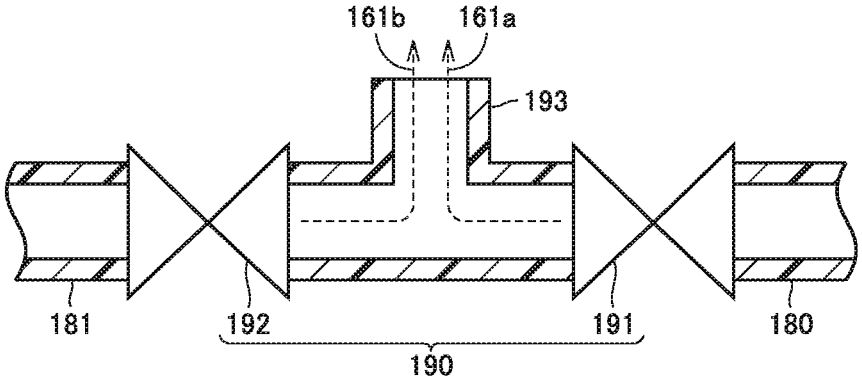
FIG. 2 is a cross-sectional view showing a structure of a flow rate ratio maintaining mechanism in the superconducting magnet according to Embodiment 1 of the present invention.

FIG. 2 is a cross-sectional view showing a structure of the flow rate ratio maintaining mechanism in the superconducting magnet according to Embodiment 1 of the present invention. FIG. 2 shows a state where a vent valve 193 which is described later is open.

As shown in FIG. 2, flow rate ratio maintaining mechanism 190 in superconducting magnet 100 according to the present embodiment is composed of hand valves provided on first pipe 180 and second pipe 181, respectively. Specifically, flow rate ratio maintaining mechanism 190 is composed of a first hand valve 191 provided on first pipe 180 and a second hand valve 192 provided on second pipe 181.

A ratio between a flow rate of helium gas 161*a* in first pipe 180 and a flow rate of helium gas 161*b* in second pipe 181 can be maintained constant through adjustment of positions of first hand valve 191 and second hand valve 192.

Vent valve 193 for venting helium gas 161 is provided downstream of flow rate ratio maintaining mechanism 190. In the present embodiment, helium gas 161 that has flowed through first pipe 180 and second pipe 181 is vented together from one vent valve 193. This embodiment is, however, not limited as such but two vent valves 193 may be provided to vent helium gas 161 that has flowed through first pipe 180 and helium gas 161 that has flowed through second pipe 181 separately from each other.

In the present embodiment, superconducting magnet 100 further includes a first thermometer 184 that is disposed in radiation shield 120 to measure a temperature of first pipe 180, and a second thermometer 185 that is disposed in radiation shield 120 to measure a temperature of second pipe 181. As first thermometer 184 and second thermometer 185, platinum resistance temperature detectors are used, which have good measurement accuracy for a cryogenic range. The thermometer is, however, not limited as such but thermocouples, for example, may also be used. Note that superconducting magnet 100 does not necessarily have to include first thermometer 184 and second thermometer 185.

Hereinafter operations of superconducting magnet 100 are described.

In superconducting magnet 100, the outside of vacuum container 110 is at a room temperature around 300 K. The lower end part of each of first pipe 180 and second pipe 181 is cooled to around 4 K substantially the same as a temperature of superconducting coil 140. First pipe 180 and second pipe 181 which extend from the outside of vacuum container 110 to coolant container 130 act as pathways of intrusion of heat into coolant container 130.

When heat intrudes into coolant container 130 through first pipe 180 and second pipe 181, liquid helium 160 vaporizes and helium gas 161 is generated. When refrigerator 170 is in operation, helium gas 161 is re-liquefied by second refrigeration stage 172 of refrigerator 170.

When there is no electric power supply, e.g., during a power breakdown or transportation of superconducting magnet 100, refrigerator 170 does not operate and helium gas 161 is not re-liquefied, which results in increase in pressure of helium gas 161 with the vaporization of liquid helium 160. When a pressure of helium gas 161 exceeds a threshold, vent valve 193 opens and helium gas 161 is vented to the outside.

Helium gas 161 flows through first pipe 180 and second pipe 181 and is vented from vent valve 193. A ratio between a flow rate of helium gas 161 in first pipe 180 and that in second pipe 181 is determined by a ratio between degrees of opening of first hand valve 191 and second hand valve 192.

For example, in a case where a degree of opening of first hand valve 191 is made twice as large as a degree of opening of second hand valve 192, a flow rate of helium gas 161 in first pipe 180 is substantially twice as large as a flow rate of helium gas 161 in second pipe 181.

Helium gas 161 cools first pipe 180 and second pipe 181 with the sensible heat while flowing through first pipe 180 and second pipe 181. A higher flow rate of helium gas 161 makes a better cooling effect with the sensible heat. Thus, a ratio between a flow rate of helium gas 161 in first pipe 180 and that in second pipe 181 determines a cooling ratio between first pipe 180 and second pipe 181.

As described above, first pipe 180 and second pipe 181 act as pathways of intrusion of heat into coolant container 130. Amounts of heat intrusion from first pipe 180 and second pipe 181 into coolant container 130 can be estimated from materials, shapes, and dimensions etc. of first pipe 180 and second pipe 181.

First pipe 180 to which refrigerator 170 is attached is larger in diameter and larger in volume of the part located outside vacuum container 110 than second pipe 181 through which current lead 141 is led out. Accordingly, an amount of heat that intrudes into coolant container 130 through first pipe 180 is larger than an amount of heat that intrudes into coolant container 130 through second pipe 181.

Thus, by setting first hand valve 191 to be higher in degree of opening than second hand valve 192, more helium gas 161 can flow into first pipe 180 larger in amount of heat intrusion than second pipe 181. First pipe 180 and second pipe 181 can be cooled with effective use of the sensible heat of helium gas 161 by determining a ratio between a flow rate of helium gas 161 in first pipe 180 and that in second pipe 181 in correspondence with a ratio between an amount of heat intrusion in first pipe 180 and an amount of heat intrusion in second pipe 181.

As a result, amounts of heat intrusion into coolant container 130 through first pipe 180 and second pipe 181 can be effectively reduced. Note that first hand valve 191 and second hand valve 192 do not require electric power. Accordingly, a ratio between a flow rate of helium gas 161 in first pipe 180 and that in second pipe 181 can be maintained and the heat intrusion into coolant container 130 and thus vaporization of liquid helium 160 can be suppressed when there is no electric power supply, e.g., during a power breakdown or transportation of superconducting magnet 100.

Although the hand valve is provided on each of first pipe 180 and second pipe 181 in superconducting magnet 100 according to the present embodiment, the hand valve may be provided only on second pipe 181 smaller in amount of heat intrusion. That is, flow rate ratio maintaining mechanism 190 only needs to be connected to at least a pipe smaller in amount of heat intrusion.

As described above, superconducting magnet 100 according to the present embodiment includes first thermometer 184 and second thermometer 185. Accordingly, a ratio between an amount of heat intrusion through first thermometer 184 and that through second thermometer 185 may be confirmed based on measurement values of first thermometer 184 and second thermometer 185, and a ratio between a flow rate of helium gas 161 in first pipe 180 and that in second pipe 181 may be determined based on the results.

That is, a position of first hand valve 191 and a position of second hand valve 192 may be adjusted based on the results of comparison between the measurement values of first thermometer 184 and second thermometer 185. This allows determination of a ratio between a flow rate of helium gas 161 in first pipe 180 and that in second pipe 181 according to the current conditions, and accordingly can more reliably suppress heat intrusion into coolant container 130.

Hereinafter a superconducting magnet according to Embodiment 2 of the present invention is described. The superconducting magnet according to this embodiment is different from superconducting magnet 100 according to Embodiment 1 only in feature of a flow rate ratio maintaining mechanism, and thus the explanations of other features are not repeated.

Embodiment 2

Figure 3:
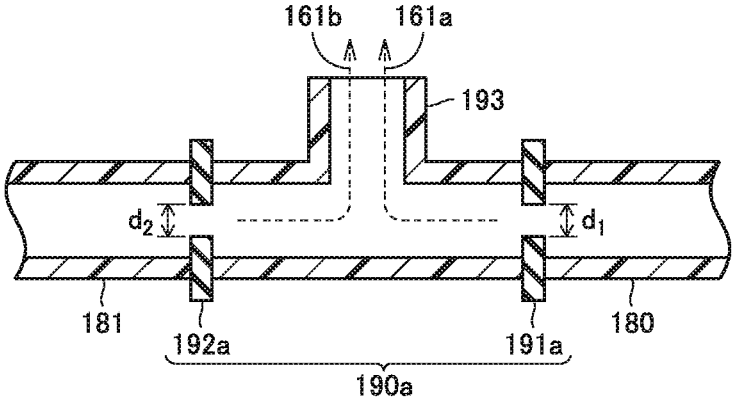
FIG. 3 is a cross-sectional view showing a structure of a flow rate ratio maintaining mechanism in a superconducting magnet according to Embodiment 2 of the present invention.

FIG. 3 is a cross-sectional view showing a structure of the flow rate ratio maintaining mechanism in the superconducting magnet according to Embodiment 2 of the present invention. FIG. 3 shows a state where vent valve 193 is open.

As shown in FIG. 3, a flow rate ratio maintaining mechanism 190*a* in the superconducting magnet according to Embodiment 2 of the present invention includes of orifices provided in first pipe 180 and second pipe 181, respectively. Specifically, flow rate ratio maintaining mechanism 190*a* includes a first orifice 191*a* provided in first pipe 180 and a second orifice 192*a* provided in second pipe 181.

Controlling an aperture diameter $d_1$ of first orifice 191*a* and an aperture diameter $d_2$ of second orifice 192*a* can maintain a constant ratio between a flow rate of helium gas 161*a* in first pipe 180 and a flow rate of helium gas 161*b* in second pipe 181.

A ratio between a flow rate of helium gas 161 in first pipe 180 and that in second pipe 181 is determined by a ratio between aperture diameters of first orifice 191*a* and second orifice 192*a*.

For example, in a case where aperture diameter $d_1$ of first orifice 191*a* is made twice as large as aperture diameter $d_2$ of second orifice 192*a*, a flow rate of helium gas 161 in first pipe 180 is substantially twice as large as a flow rate of helium gas 161 in second pipe 181.

First orifice 191*a* and second orifice 192*a* do not require electric power. Accordingly, a ratio between a flow rate of helium gas 161 in first pipe 180 and that in second pipe 181 can be maintained and the heat intrusion into coolant container 130 and thus vaporization of liquid helium 160 can be suppressed when there is no electric power supply, e.g., during a power breakdown or transportation of the superconducting magnet.

Although the orifice is provided in each of first pipe 180 and second pipe 181 in the superconducting magnet according to the present embodiment, the orifice may be provided only in second pipe 181 smaller in amount of heat intrusion. That is, flow rate ratio maintaining mechanism 190*a* only needs to be connected to at least a pipe smaller in amount of heat intrusion.

The embodiments disclosed herein are illustrative in every respect, and do not serve as a basis for limitative interpretation. Therefore, the technical scope of the present invention should not be interpreted only based on the embodiments described above, but is defined based on the description in the scope of the claims. Further, any modification within the scope and meaning equivalent to the scope of the claims is included.

REFERENCE SIGNS LIST

100: superconducting magnet; 110: vacuum container; 120: radiation shield; 121: heat transfer plate; 130: coolant container; 131: support rod; 132: reel; 140: superconducting coil; 141: current lead; 150: multi-layer heat insulating material; 160: liquid helium; 161, 161*a*, 161*b*: helium gas; 170: refrigerator; 171: first refrigeration stage; 172: second refrigeration stage; 180: first pipe; 181 second pipe; 182: mounting opening; 183: lead-out opening; 184: first thermometer; 185: second thermometer; 190, 190*a*: flow rate ratio maintaining mechanism; 191: first hand valve; 191*a*: first orifice; 192: second hand valve; 192*a*: second orifice; 193: vent valve; $d_1$, $d_2$: aperture diameter

The invention claimed is:

1. A superconducting magnet comprising:

a superconducting coil;

a coolant container containing the superconducting coil in a state where the superconducting coil is immersed in liquid coolant;

a radiation shield surrounding the coolant container;

a vacuum container containing the superconducting coil, the coolant container, and the radiation shield;

a refrigerator for cooling the radiation shield and inside of the coolant container;

a current lead electrically connected to the superconducting coil;

a first pipe passing through the vacuum container and the radiation shield and leading to the inside of the coolant container to form a flow path of vaporized coolant, the first pipe including a mounting opening in which the refrigerator is inserted and fixed;

a second pipe passing through the vacuum container and the radiation shield and leading to the inside of the coolant container to form another flow path of vaporized coolant, the second pipe including a lead-out opening through which the current lead passes to be led out;

a flow rate ratio maintaining mechanism connected to a downstream side of the mounting opening of the first pipe and a downstream side of the lead-out opening of the second pipe, the flow rate ratio maintaining mechanism allowing the vaporized coolant to flow through the first pipe and the second pipe at a constant flow rate ratio corresponding to a ratio between an amount of heat intrusion in the first pipe and an amount of heat intrusion in the second pipe; and a vent valve provided downstream of the flow rate ratio maintaining mechanism, the vent valve allowing the vaporized coolant that flows through the first pipe and the vaporized coolant that flows through the second pipe to be vented together.

2. The superconducting magnet according to claim 1, wherein the flow rate ratio maintaining mechanism comprises a hand valve provided on each of the first pipe and the second pipe.

3. The superconducting magnet according to claim 2, the superconducting magnet further comprising:

a first thermometer disposed in the radiation shield to measure a temperature of the first pipe; and a second thermometer disposed in the radiation shield to measure a temperature of the second pipe.

4. The superconducting magnet according to claim 1, wherein the flow rate ratio maintaining mechanism comprises an orifice provided in each of the first pipe and the second pipe.

* * * * *